US010994278B2

(12) United States Patent
Daams et al.

(10) Patent No.: US 10,994,278 B2
(45) Date of Patent: May 4, 2021

(54) BEARING HOUSING SUPPORT OF A DOUBLE-ROLL CRUSHER

(71) Applicant: TAKRAF GMBH, Leipzig (DE)

(72) Inventors: Jürgen Peter Daams, Aachen (DE); Marcelino De La Cruz Y Aranda, Kaufbeuren (DE); Meinhard Frangenberg, Kürten-Engeldorf (DE)

(73) Assignee: TAKRAF GMBH, Leipzig (DE)

( * ) Notice: Subject to any disclaimer, the term of this patent is extended or adjusted under 35 U.S.C. 154(b) by 115 days.

(21) Appl. No.: 16/302,752

(22) PCT Filed: May 23, 2017

(86) PCT No.: PCT/EP2017/062386
§ 371 (c)(1),
(2) Date: Nov. 19, 2018

(87) PCT Pub. No.: WO2017/202835
PCT Pub. Date: Nov. 30, 2017

(65) Prior Publication Data

US 2019/0217305 A1 Jul. 18, 2019

(30) Foreign Application Priority Data

May 27, 2016 (DE) ..... 102016209247.2

(51) Int. Cl.
*B02C 4/32* (2006.01)
*B30B 3/04* (2006.01)
(Continued)

(52) U.S. Cl.
CPC ..... *B02C 4/32* (2013.01); *B02C 4/28* (2013.01); *B30B 3/04* (2013.01); *B30B 15/04* (2013.01)

(58) Field of Classification Search
CPC .... B02C 4/02; B02C 4/10; B02C 4/32; B02C 4/34; B02C 15/00
See application file for complete search history.

(56) References Cited

U.S. PATENT DOCUMENTS 3,845,906 A * 11/1974 Lillig ..... B02C 4/32 241/32
4,077,316 A * 3/1978 Georget ..... C13B 10/06 100/163 R
(Continued)

FOREIGN PATENT DOCUMENTS

AU 2015238518 B2 10/2015
CL 2010001632 A1 6/2011
(Continued)

OTHER PUBLICATIONS

International Search Report issued in PCT/EP2017/062386 dated Aug. 16, 2017.

*Primary Examiner* — Matthew Katcoff
(74) *Attorney, Agent, or Firm* — Heslin Rothenberg Farley & Mesiti P.C.; Kristian E. Ziegler, Esq.

(57) ABSTRACT

A device for supporting a roller bearing housing of a double-roll crusher is provided, wherein each roller has a fixed bearing with a non-self-aligning design and a floating bearing with a non-self-aligning design, and wherein at least one load distribution element is arranged between the machine frame of the double-roll crusher and the housing of each roller bearing. The at least one load distribution element has at least two elastic, spatially separated individual elements, with at least one recess between the individual elements providing a spatial separation in the vertical direction.

17 Claims, 3 Drawing Sheets

Figure 1:
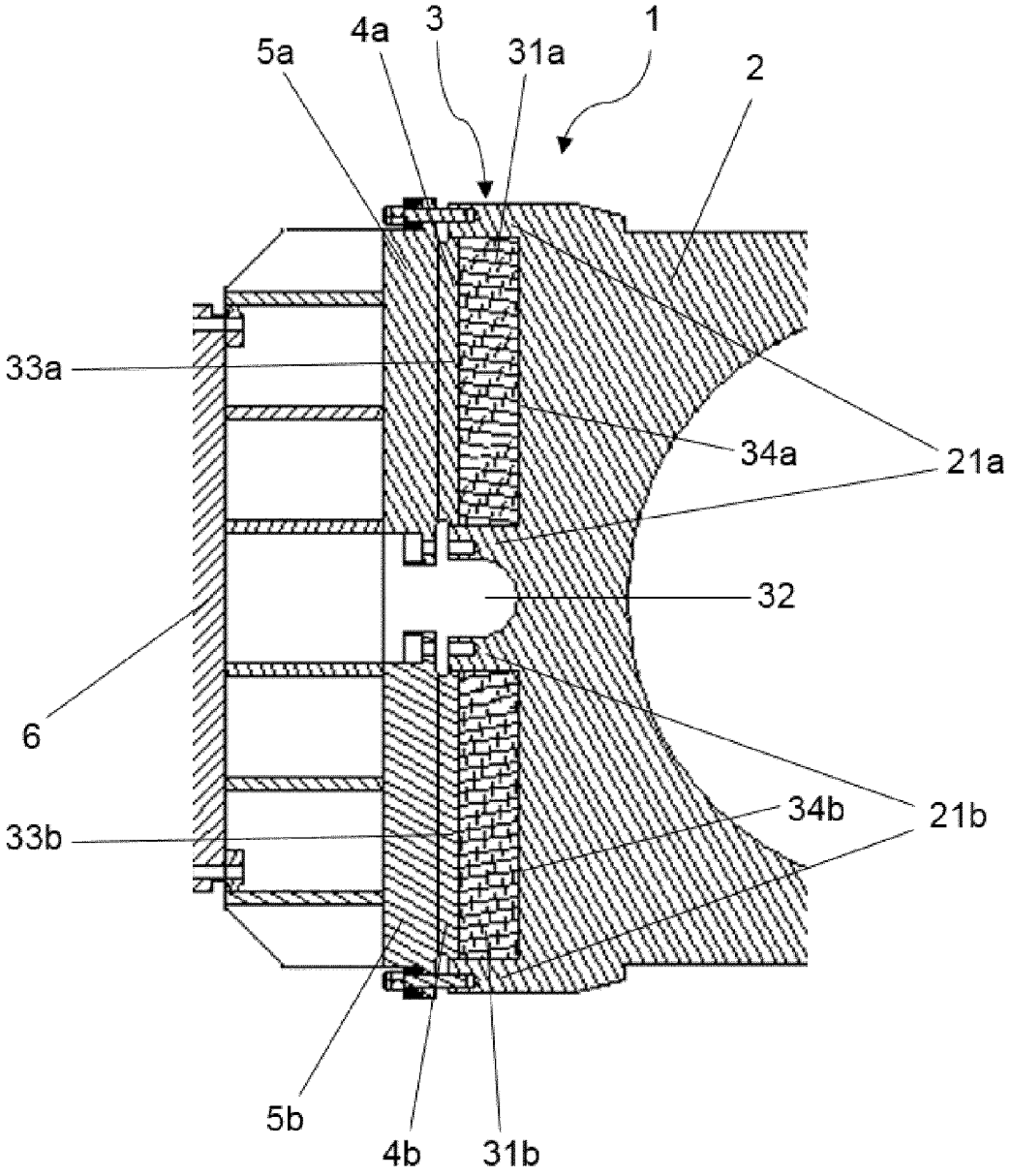

(51) Int. Cl.
*B30B 15/04* (2006.01)
*B02C 4/28* (2006.01)

(56) References Cited

U.S. PATENT DOCUMENTS

| | | | | |
|---|---|---|---|---|
| 8,297,847 | B2 * | 10/2012 | Niklewski | B02C 4/28 384/432 |
| 8,517,296 | B2 * | 8/2013 | Frerich | B02C 4/32 241/230 |
| 8,833,686 | B2 * | 9/2014 | Ruther | B02C 4/32 241/227 |
| 9,919,315 | B2 * | 3/2018 | Pearson | B02C 4/38 |
| 2012/0111982 | A1 | 5/2012 | Rüther et al. | |

FOREIGN PATENT DOCUMENTS

| | | | |
|---|---|---|---|
| CL | 2016002320 | A1 | 6/2017 |
| DE | 2633748 | A1 | 2/1977 |
| DE | 3635885 | A1 | 5/1988 |
| DE | 4034822 | A1 | 4/1992 |
| DE | 102010038197 | A1 | 4/2012 |
| WO | 2010001225 | A1 | 1/2010 |

* cited by examiner

BEARING HOUSING SUPPORT OF A DOUBLE-ROLL CRUSHER

CROSS REFERENCE TO RELATED APPLICATIONS

This application is the National Phase filing under 35 U.S.C. § 371 of International Application No.: PCT/EP2017/062386, filed on May 23, 2017, and published on Nov. 30, 2017 as WO 2017/202835 A1, and claims priority to German Application No.: 10 2016 209 247.2, filed on May 27, 2016. The contents of each of the prior applications are hereby incorporated by reference herein in their entirety.

BACKGROUND ART

The invention relates to a device for supporting a rolling mill bearing housing of a two-high roller press, in which both rollers respectively exhibit a fixed bearing in a design such that it cannot move at an angle and floating bearing in a design such that it cannot move at an angle, and in which between the machine frame of the two-high roller press and the housing of each rolling mill bearing, at least one load distribution element is arranged, and a rolling mill bearing that exhibits a bearing housing support according to the invention.

Two-high roller presses, also designated high-compression roller mills, are used for pressure-crushing of medium-hardness to brittle materials. They comprise two driven rollers rotating in opposite directions, between which there is a milling gap. One of the rollers is formed as a fixed roller supported so that it is stationary and the other roller is supported so that it can move transverse to the milling gap. The floating roller is spring-supported with a correspondingly high pressure, normally applied by hydraulic cylinders, through which the input material located between the rollers is pressed against the fixed roller. In the context of pressure regulation, the hydraulic elements on the floating roller side adjust the milling force and therefore the gap between the floating and fixed rollers when in operation (operating gap).

The force-exerting support of the rollers is done horizontally on vertical elements of the machine frame. The forces exerted in the pressure treatment are therefore directed via the rolling mill bearings into the machine frame. For the rolling mill bearing, roller bearings are usually used. From DE 36 35 885 C2, the use of spherical roller bearings that exhibit an angular movement of only a few degrees are known, on which bearing housing a thin rubber body is arranged on the fixed roller side to compensate for tolerances.

A tilting in the roller bearing, as may occur for the floating roller may not be compensated for by the bearing that cannot move at an angle, depending on construction. From DE 40 34 822 A1, a rolling mill bearing is known with non-oscillating bearings that are guided over the rubber pressure bearings in a swivel movement, and at the same time, the pressing forces are distributed using this elastic body (rubber cushion) through the bearing housing onto the roller bearing.

The elastic bodies, e.g. rubber cushions, firstly draw on the function of guaranteeing an optimum, i.e. as homogeneous as possible load distribution on the roller bearing. In particular, the forces acting by the exertion of force from the hydraulic cylinders and pressing elements on the bearing of the floating roller are distributed optimally over the bearing housing onto the rolling elements. Secondly, on the sides of the floating roller there are slight angular movements, resulting from the tilting and deflection of the roller, and on the fixed-roller side manufacturing tolerances and deflection that are to be compensated for. Slight angular movements from the possible tilting and deflection of the floating roller may only be accepted if the rubber element has a sufficient thickness.

To fulfil the functions mentioned above, according to the prior art, on the floating roller side respectively a thick, soft rubber element is used for each bearing and on the fixed roller side a thin, hard rubber element is used for each bearing. In particular, on the side of the fixed roller, this produces a stiffening under load and therefore not a good load distribution on the bearing housing on the load side, so that a few roller elements are heavily loaded in the direction of the load. Optimum, on the other hand, is as homogeneous as possible a distribution of the load in terms of magnitude to as many roller elements as possible.

The invention is based on the task of overcoming the stated disadvantages of the prior art, by the load distribution on the roller bearings of the fixed and floating roller being optimised or mutually compensated for by the fixed and floating roller.

This task is solved by a device for supporting a rolling mill bearing housing of a two high roller press with the characteristics of claim 1. Advantageous embodiments arc specified in the dependent claims.

SUMMARY OF THE INVENTION

The solution of this task manages to provide the support according to the invention of a rolling mill bearing housing for a two-high roller press so that a load distribution element in the housing is arranged for each bearing, designed not be moved at an angle, of the two rollers of the roller press, which exhibits at least two separate elastic individual elements, between which an intermediate space is located not filled with a solid or liquid medium, in which this gap represents an interruption of the load distribution element in the vertical direction. This gap is therefore arranged in the region of the greatest-acting bearing load.

Through the support according to the invention of the rolling mill bearing housing, the roller elements in the region of the greatest-acting bearing load are unloaded advantageously and compared with the known devices, the load is distributed more uniformly over a greater number of roller elements. This results in an increase of the service life of the bearing with the performance remaining the same or an increase in the pressing force with the same service life of the bearing. Finally, this makes it possible to install larger bearings with an increase in the throughput performance of the roller press.

Compared with solutions known from the prior art, the contact surfaces of the individual elements of a load distribution element on the bearing housing are moved up and down in a vertical direction, which also contributes to an optimisation of the load distribution on the rolling mill bearing.

Preferably, the elastic individual elements of a load distribution element are charged over their surface located opposite the contact surface on the bearing housing, respectively with a precisely-fitting, non-elastically designed pressure transfer element. These pressure transfer elements are preferably made of a steel. The pressure transfer elements are arranged on the fixed roller side on a contact surface (vertical pillars as end piece) of the machine frame of the roller press. On the floating roller side located between the pressure transfer elements and the machine frame, the hydraulic cylinders are arranged with their pressing forces.

In a further preferred embodiment of the rolling mill bearing housing support according to the invention, the load distribution element is designed symmetrical to a horizontal plane. Particularly preferably, the horizontal plane is identical to the horizontal central plane of the bearing housing. In the event that the load distribution element comprises precisely two individual elements, the plane of symmetry of the horizontal central plane of the gap between the individual elements and the two individual elements exhibit the same dimensions.

In a further preferred embodiment of the rolling mill bearing housing support, the load distribution element is of the same construction for all bearings of the two-high roller press, therefore for the fixed and floating bearing, both on the fixed and the floating roller. It is advantageous that the load of the rolling elements of the bearings of the fixed and floating roller is virtually uniform.

In a further preferred embodiment of the support for the rolling mill bearing housing, cylindrical roller bearings are used as the bearings that do not move at an angle. Typically, these are implemented in four rows. Cylindrical roller bearings are characterised, in comparison with bearings that move at an angle, e.g. spherical roller bearings, particularly in that they are more robust in operation and are considerably cheaper for large bearings.

In a further preferred embodiment of the rolling mill bearing housing support according to the invention, the elastic individual elements of a load distribution element are cuboid and exhibit a rectangular cross-section.

In a further preferred embodiment of the rolling mill bearing housing support according to the invention, the elastic individual elements of a load distribution element are made of an elastomer.

In a further preferred embodiment of the rolling mill bearing housing support according to the invention, the elastic individual elements of a load distribution element are made of rubber or polyurethane. It is advantageous that the load distribution elements, which are consumable parts, are therefore cheap, easy to handle and replace.

In a further preferred embodiment of the rolling mill bearing housing support according to the invention, an individual elastic element of a load distribution element has an enclosed edge which is open to the surface on the rolling mill bearing housing opposite the contact surface or to the contact surface on the rolling mill bearing housing and to the surface opposite the said contact surface. The properties of an elastic individual element therefore exhibit analogies to those of an incompressible hydraulic fluid. The edge may be made of a supporting plate, normally made of steel. Particularly preferably, the height of the edge is greater than the height of the elastic individual element and extends in the horizontal direction over its surface opposite the contact surface on the bearing housing. Non-elastic pressure transfer elements are then arranged precisely fitting into the protruding edge of the individual element.

In a preferred embodiment, the closed edge of an elastic individual element is formed in that the individual element is inserted into a precisely-fitting indentation or groove arranged on the rolling mill bearing housing, and on which the side surface of the individual element not covered by the boundary surfaces of the groove are arranged force-fitted with the supporting elements connected to the bearing housing. The advantages of this embodiment are weight-optimised components and simple replacement of the individual elements as consumable parts, by removing the force-fitted supporting elements connected to the bearing housing.

Furthermore, the task according to the invention is solved by a rolling mill bearing, that exhibits a rolling mill bearing housing support according to the invention, according to one of the embodiments described above.

BRIEF DESCRIPTION OF THE DRAWING FIGURES

The invention is explained in more detail below using illustrative examples with reference to the illustrations, without these being limiting.

Figure 2:
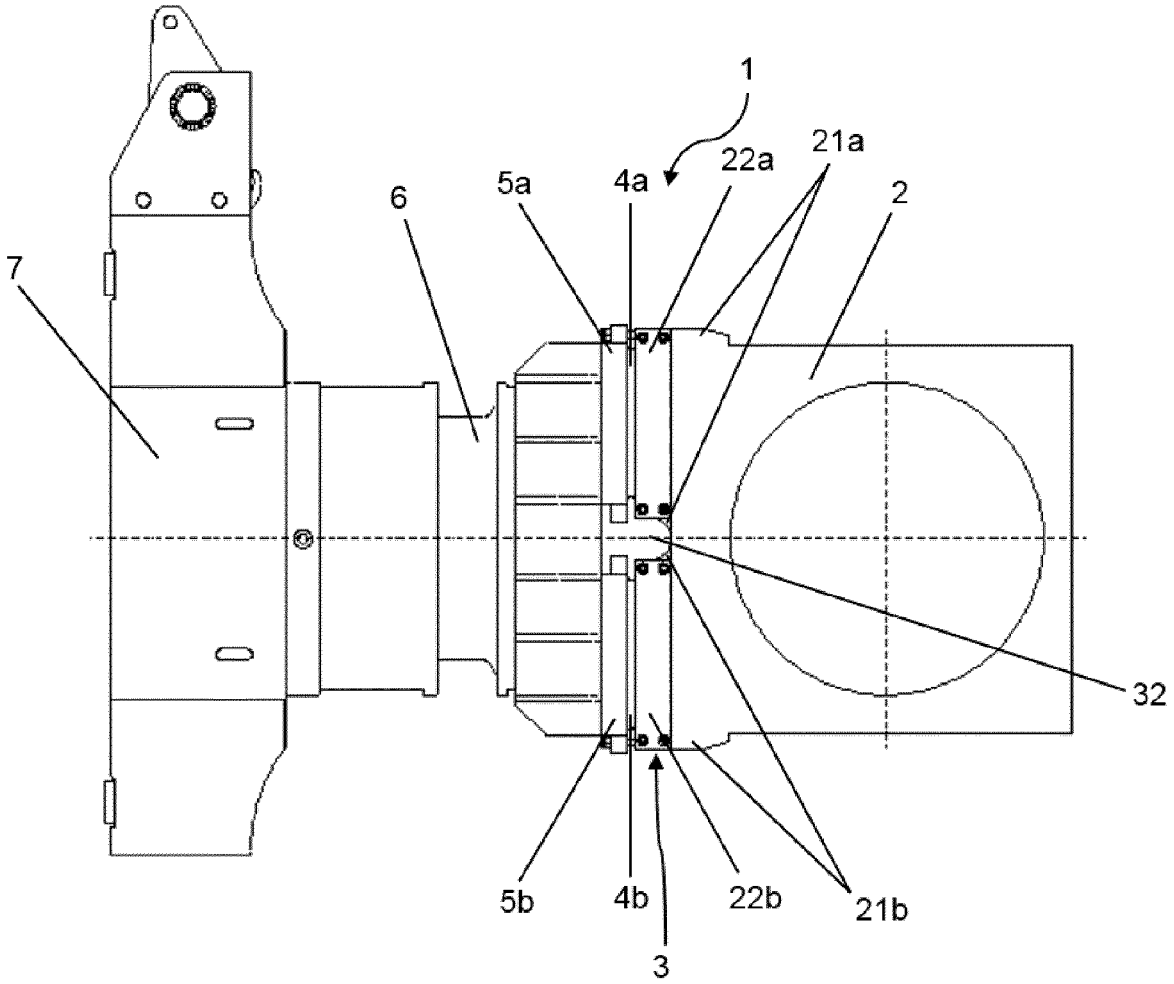
Figure 3:
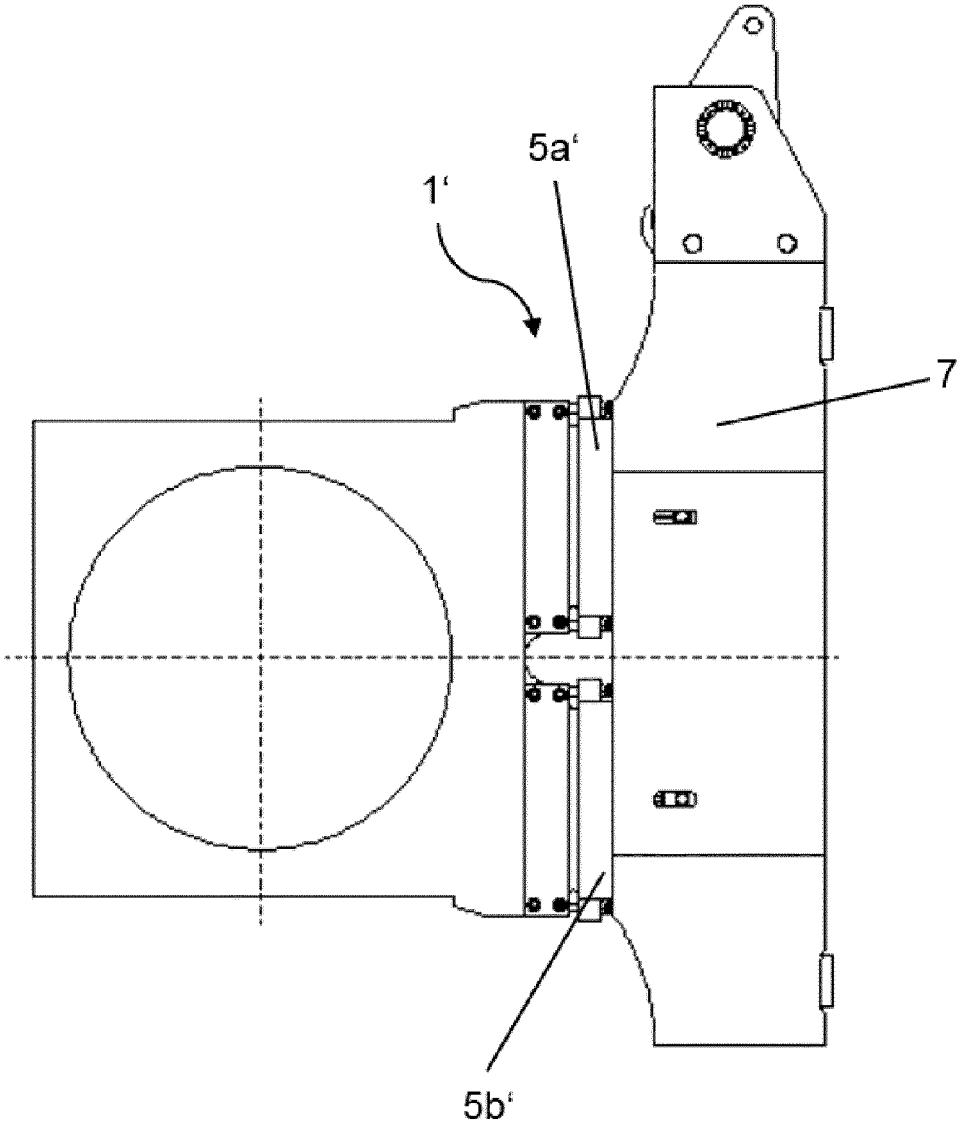

Respectively schematically:

FIG. 1 shows a vertical cross-section of a bearing housing support according to the invention for the floating roller, FIG. 2 shows a side view of a section of the floating roller side of a two-high roller press with the bearing housing support of the floating roller according to the invention, FIG. 3 shows a side view of a section of the fixed roller side of a two-high roller press with the bearing housing support for the fixed roller according to the invention,

DETAILED DESCRIPTION

FIG. 1 schematically shows a vertical cross-section of an illustrative example of a bearing housing support 1 according to the invention for the floating roller in a two-high roller press, in which the axis of rotation of the floating roller is vertical to the plane of the drawing. The shaft of the floating roller is supported in cylindrical roller bearings with cylindrical roller elements (not shown). On bearing housing 2 of a cylindrical roller bearing rests a load distribution element 3, which exhibits two equivalent, cuboid elastic individual elements 31*a*, 31*b*, for example rubber elements, in which the elastic individual element 31*a* is arranged on the upper half of the bearing housing and the elastic individual element 31*b* is arranged on the lower half of the bearing housing. The individual elements 31*a*, 31*b* extend in the horizontal direction over the entire width of the bearing housing 2. In a vertical direction, the load distribution element 3 encloses somewhat with the upper and lower cover surface of the bearing housing 2. Between the individual elements 31*a*, 31*b* is located a recess 32 which, as with the load distribution element 3, is symmetrical in relation to the horizontal central plane of the bearing housing 2. On the surface 33*a*, 33*b* of an individual element 31*a*, 31*b*, opposite to the surface 34*a*, 34*b* resting on the bearing housing 2, precisely fitting metal stamps 4*a*, 4*b* are arranged as means of transferring pressure, in which the size of the contact surface of the metal stamps 4*a*, 4*b* corresponds to the individual elements 31*a*, 31*b* of the size of surface 33*a*, 33*b*. Each individual element 31*a*, 31*b* is enclosed by a closed edge. This is illustrated in the horizontal direction (vertical to the plane of the drawing) by raised supporting walls 21*a*, 21*b* welded onto the bearing housing (each individual element 31*a*, 31*b* is therefore guided into a horizontally-aligned groove) and in a vertical direction (parallel to the plane of the drawing) on both sides are supporting plates (not shown) fastened by force-fit to the bearing housing 2 and to the horizontal supporting walls 21*a*, 21*b* (not shown). Each individual element 31*a*, 31*b* is enclosed piston-like by the supporting walls 21*a*, 21*b* and the supporting plates (not shown). The supporting walls 21*a*, 21*b* and the supporting plates (not shown) extend over the relevant individual element 31*a*, 31*b* on the surface 33*a*, 33*b*, so that also the section of the stamp 4*a*, 4*b* facing towards the surface 33*a*, 33*b* is enclosed and supported by the edge of the individual element 31*a*, 31*b*. The stamps 4*a*, 4*b* are respectively connected via an articulated and sprung screw connection to spacers 5*a*, 5*b*. The spacers 5*a*, 5*b* are connected to a hydraulic cylinder 6 for the application of the pressing force.

FIG. 2 shows in sections a side view of the floating roller side of a two-high roller press with bearing housing support 1 according to the invention, as shown in FIG. 1. In this case, the axis of rotation of the roller (not shown) is vertical to the plane of the drawing. The bearing housing 2 exhibits a load distribution element 3 with two spatially-separated, elastic individual elements (concealed here), between which a recess 32 is located, that is symmetrical in relation to the horizontal central plane of the bearing housing 2 (indicated by the horizontal dotted line). The enclosed edge of the individual elements (concealed here) is formed in the horizontal direction by the supporting walls 21*a*, 21*b* (partially concealed) welded onto the bearing housing 2 and in the vertical direction by the supporting plates 22*a*, 22*b* connected by force-fit with the supporting walls. The enclosed edge therefore supports a section of the stamps 4*a*, 4*b* resting on the individual elements. The stamps 4*a*, 4*b* are connected by an articulated and sprung screw connection with spacers 5*a*, 5*b*, that is in turn connected to a hydraulic cylinder 6 for applying the pressing force. The hydraulic cylinder 6 is fastened to the vertical pillars 7 of the machine frame of the two-high roller press. The bearing housing support 1 according to the invention is of identical construction for the fixed bearing and floating bearing side of the floating roller.

FIG. 3 shows sections of a side view of the fixed roller side of a two-high roller press with a bearing housing support 1' according to the invention. As in FIG. 2, the axis of rotation of the roller (not shown) is vertical to the plane of the drawing. The bearing housing support 1' on the fixed bearing and floating bearing side of the fixed roller side is the same construction as the bearing housing support 1 on both bearing sides of the floating bearing, as shown in FIG. 1 and FIG. 2. In contrast to the floating bearing side, the spacers 5*a*', 5*b*' on the fixed roller side are fastened directly to the vertical pillars 7' of the machine frame of the two-high roller press.

REFERENCE NUMBERS

1,1' Bearing housing support
2 Bearing housing
21*a* Upper supporting wall
21*b* Lower supporting wall
22*a* Upper supporting plate
22*b* Lower supporting plate
3 Load distribution element
31*a* Upper individual element
31*b* Lower individual element
32 Recess
33*a* The side surface of the upper individual element opposite the contact surface on the bearing housing
33*b* The side surface of the lower individual element opposite the contact surface on the bearing housing
34*a* Contact surface on the bearing housing of the upper individual element
34*b* Contact surface on the bearing housing of the lower individual element
4*a* Upper stamp
4*b* Lower stamp
5*a*, 5*a*' Upper spacer
5*b*, 5*b*' Lower spacer
6 Hydraulic cylinder
7, 7' Vertical pillar

The invention claimed is:

1. A rolling mill bearing housing assembly for a two-high roller press, in which both rollers respectively exhibit a fixed bearing in a design that cannot be moved at an angle and a floating bearing in a design that cannot be moved at an angle, said rolling mill bearing housing assembly comprising:

at least one load distribution element comprising at least two spatially-separate, elastic individual elements spaced along a vertical direction; and at least one bearing housing comprising:

a bearing opening configured to support the fixed or floating bearing therein and having an axis extending along a horizontal direction, the horizontal direction being transverse to the vertical direction; and at least two support surfaces on a first side of the at least one bearing housing;

wherein a first side of the at least one load distribution element is positioned against the at least two support surfaces, and wherein the at least one bearing housing further comprises at least one recess extending into the first side of the at least one bearing housing positioned between the at least two support surfaces and the at least two individual elements in the vertical direction that forms an open spatial separation therebetween in the vertical direction.

2. The assembly according to claim 1, further comprising a non-elastic pressure transfer element fitted against a second side of each of the at least two individual elements that opposes the first side thereof.

3. The assembly according to claim 1, wherein the at least one load distribution element is symmetrical to a horizontal plane.

4. The assembly according to claim 1, wherein the at least one load distribution element is of the same construction for all rolling mill bearings of the two-high roller press.

5. The assembly according to claim 1, wherein the bearing opening is configured to support a cylindrical roller bearing.

6. The assembly according to claim 1, wherein the at least two individual elements of the at least one load distribution element are cuboid shaped.

7. The according to claim 1, wherein the at least two individual elements of the at least one load distribution element comprise an elastomer.

8. The assembly according to claim 1, wherein the individual elements of the at least one load distribution element comprise one of rubber or polyurethane.

9. The assembly according to claim 1, wherein the at least two support surfaces are recesses surface portions of the first side of the at least one bearing housing such that they are at least partially enclosed by an closed edge.

10. The assembly according to claim 9, wherein the closed edge is formed partially by supporting wall portions that extend in the horizontal direction and are positioned above and below each of the at least two support surfaces, the supporting wall portions extending along at least a portion of a thickness of the individual elements from the first side to a second side thereof that opposes the first side.

11. A rolling mill bearing assembly for a two-high roller press, comprising:

the rolling mill bearing housing assembly according to claim 1; and at least one bearing installed in the bearing opening of the at least one bearing housing.

12. The assembly according to claim 10, wherein the supporting wall portions extend past the second side of the individual elements.

13. The assembly according to claim 10, wherein the at least one recess is positioned between a first supporting wall portion and a second wall portion along the vertical direction such that the open spatial separation is positioned therebetween in the vertical direction.

14. The assembly according to claim 13, wherein the first and second supporting wall portions form the at least one recess.

15. The assembly according to claim 13, wherein the first supporting wall portion is positioned below a first support surface of the at least two support surfaces and a first individual element of the at least two individual elements that is positioned against the first support surface, and wherein the second supporting wall portion is positioned below a second support surface of the at least two support surfaces and a second individual element of the at least two individual elements that is positioned against the second support surface.

16. The assembly according to claim 10, wherein the closed edge is formed partially by supporting plates that extend in the vertical direction and are positioned on left and right sides of each of the at least two support surfaces along the horizontal direction.

17. The assembly according to claim 16, wherein a pair of the supporting wall portions and a pair of the support plates form respective closed edges that fully enclose each of the at least two supporting surfaces.

* * * * *